US005741018A

United States Patent [19]

Huang

[11] Patent Number: 5,741,018

[45] Date of Patent: Apr. 21, 1998

[54] ADJUSTABLE ROLLER SKATE BOOT DEVICE

[76] Inventor: Yu-Lin Huang, 56, Min Sheng Street, Fengyuan, Taichung, Taiwan

[21] Appl. No.: 826,775

[22] Filed: Apr. 7, 1997

[51] Int. Cl.[6] ..... A63C 17/00

[52] U.S. Cl. ..... 280/11.3; 280/11.26; 36/115

[58] Field of Search ..... 280/11.3, 11.31, 280/11.32, 11.33, 11.34, 11.19, 11.27, 11.28, 841, 11.12, 11.26; 36/115, 116, 117.6, 117.7

[56] References Cited

U.S. PATENT DOCUMENTS

| | | | |
|---|---|---|---|
| 3,936,061 | 2/1976 | Wada | 280/11.26 |
| 4,008,901 | 2/1977 | Conn | 280/11.3 |
| 4,379,504 | 4/1983 | Welker | 280/11.3 |
| 5,184,834 | 2/1993 | Yu | 280/11.26 |
| 5,421,596 | 6/1995 | Lee | 280/11.26 |

*Primary Examiner*—Richard M. Camby

[57] ABSTRACT

A roller skate boot device comprises a base seat, a first plate mount disposed on the base seat, a second plate mount disposed on the base seat, a third plate mount disposed on the base seat, a plurality of positioning plates disposed on the base seat, a boot casing, four connecting plates, and a positioning block. The boot casing has four boot plates. The first plate mount has a first rail, a plurality of first grooves and a plurality of round holes. The second plate mount has two second rails, a plurality of second grooves, a center hole and a spacing. The third plate mount has a third rail, a plurality of third grooves and a plurality of circular holes. Each positioning plate has a rectangular hole, a recess and two C-shaped notches. Each boot plate has a boot wall and a plurality of slots formed on the boot wall. Each connecting plate has a retaining ring, an inserted hole and two C-shaped grooves. The positioning block has four protruded flanges.

2 Claims, 6 Drawing Sheets

ADJUSTABLE ROLLER SKATE BOOT DEVICE

BACKGROUND OF THE INVENTION

This invention relates to an adjustable roller skate boot device, and more particularly, this invention relates to a roller skate boot device which is easily adjusted.

A traditional roller skate boot cannot be adjusted according to a size of a shoe disposed in the roller skate boot. The user may not perform very well because the user will feel uncomfortable while the unjustable roller skate boot is used.

SUMMARY OF THE INVENTION

An object of this invention is to provide a roller skate boot device which is easily adjusted according to a size of a shoe disposed in the roller skate boot device.

DETAILED DESCRIPTION OF THE INVENTION

Figure 1:
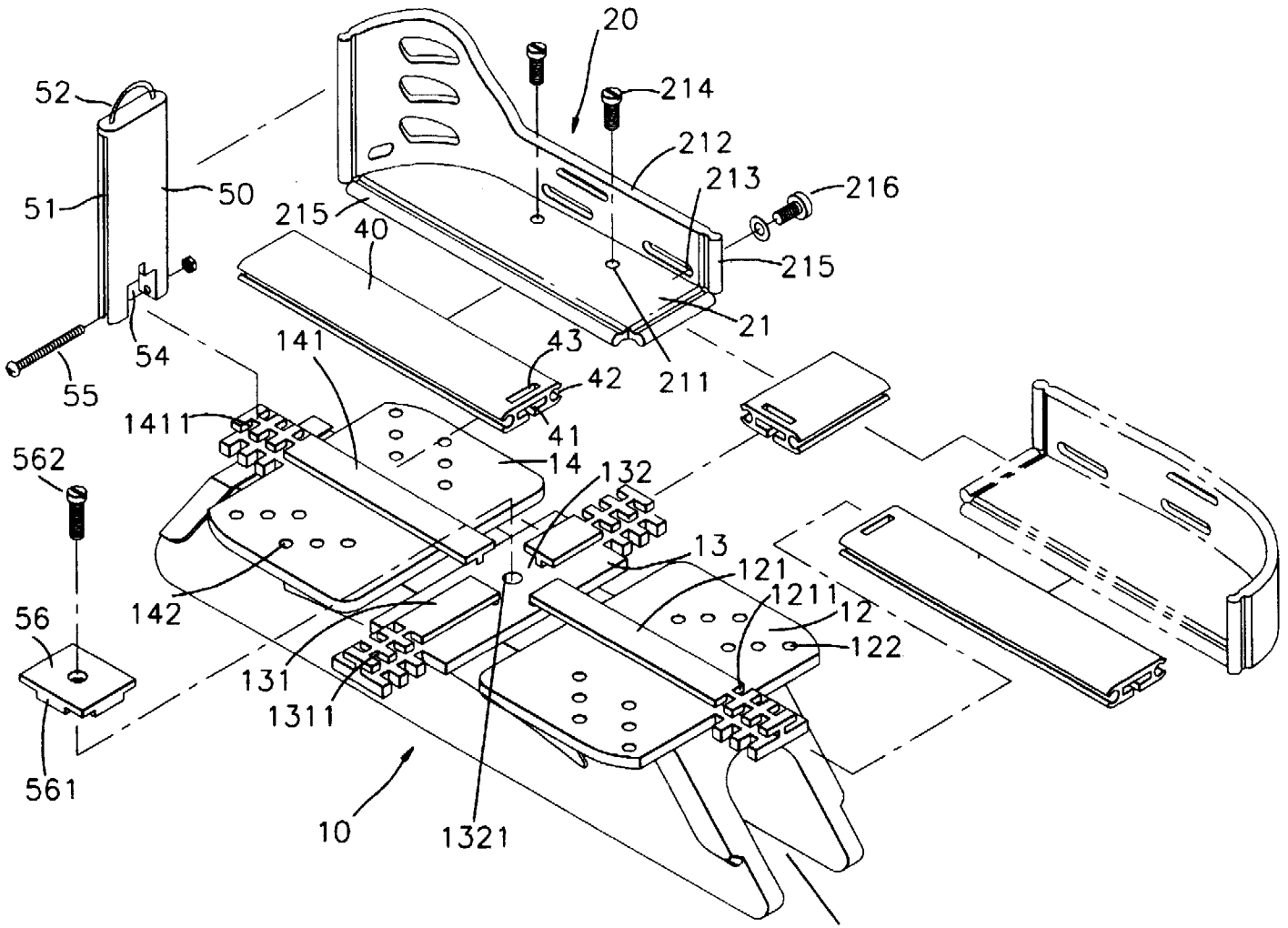
FIG. 1 is a perspective exploded view of a roller skate boot device of a preferred embodiment in accordance with this invention.
Figure 2:
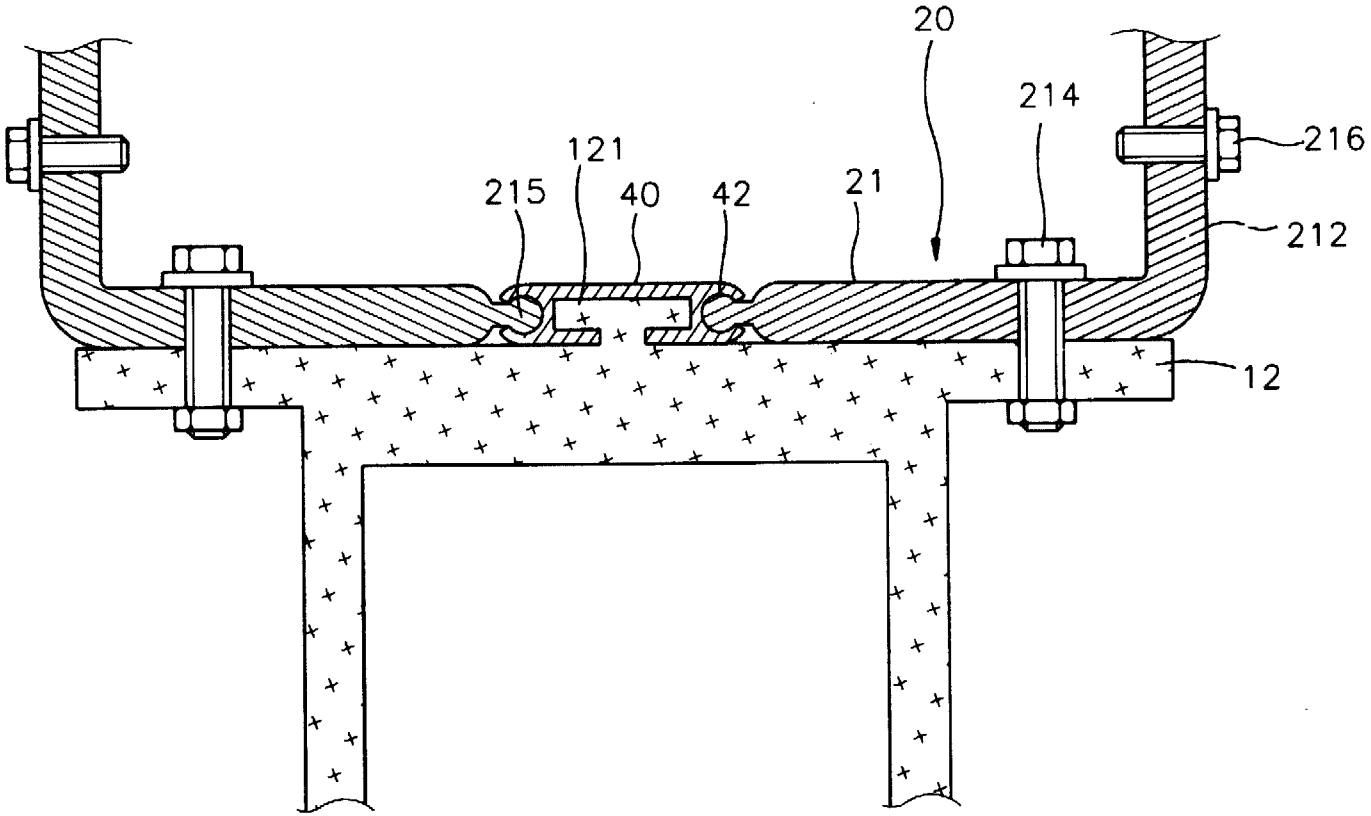
FIG. 2 is a sectional view of a roller skate boot device.
Figure 3A:
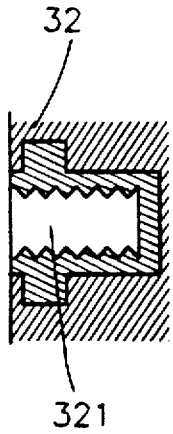
FIG. 3 is a schematic view illustrating a shoe disposed on a roller skate boot device.
Figure 3:
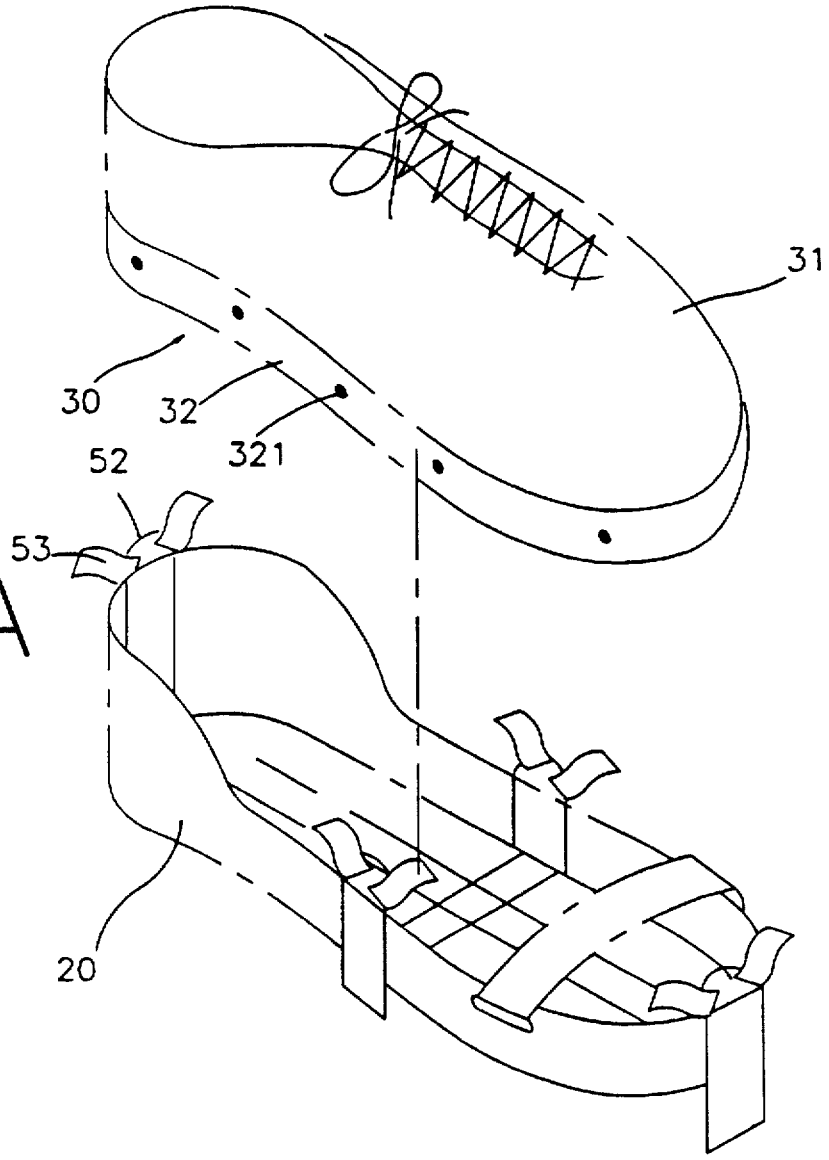
Figure 4:
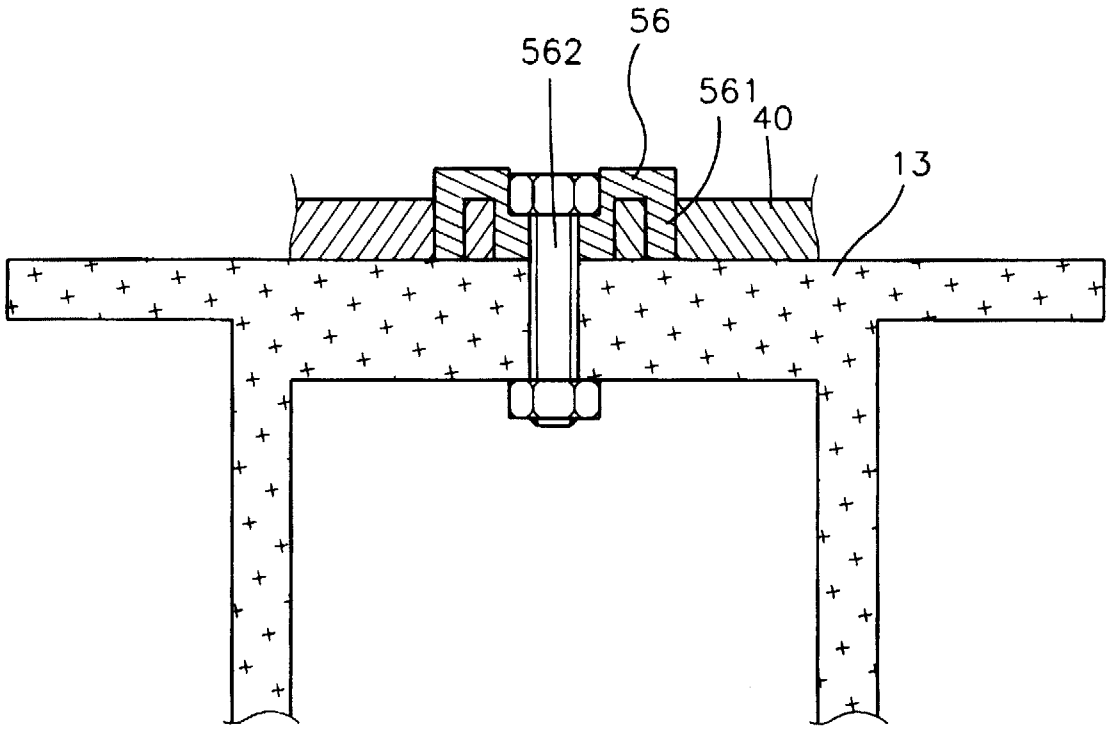
FIG. 4 is a sectional view of a connecting plate and a positioning plate.
Figure 5A:
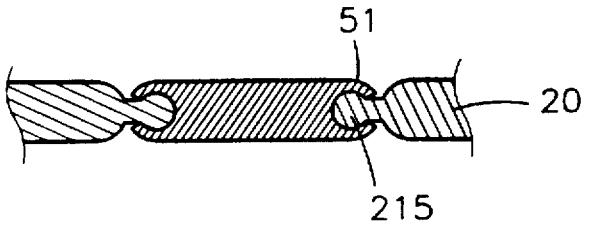
FIG. 5 is a schematic view illustrating a connection of a connecting plate and a positioning plate.
Figure 5:
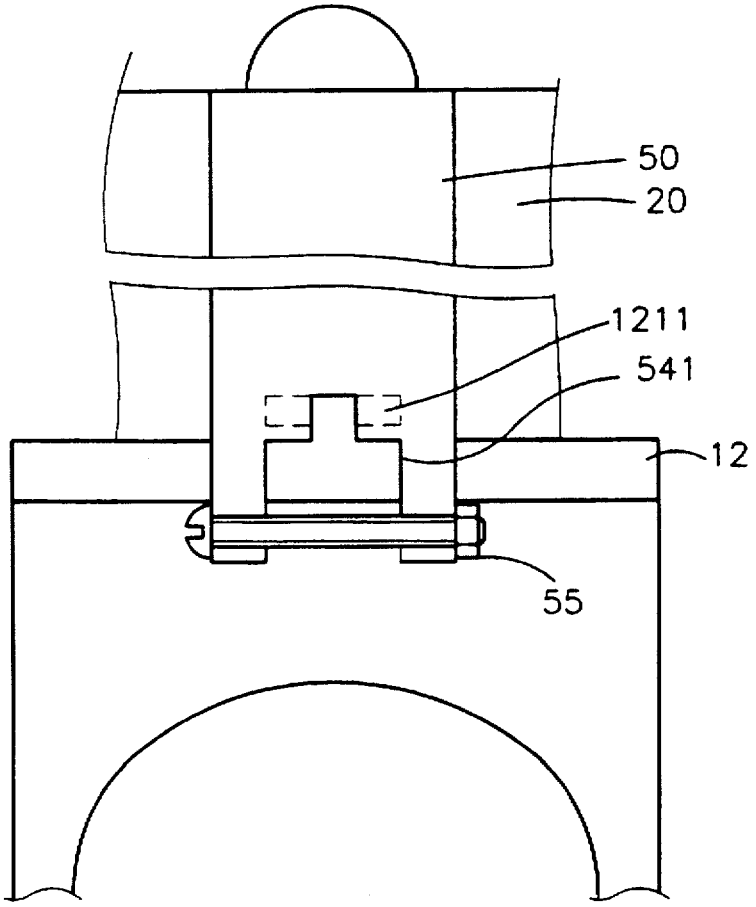

Referring to FIGS. 1 to 5, a roller skate boot device comprises a base seat 10, a first plate mount 12 disposed on the base seat 10, a second plate mount 13 disposed on the base seat 10, a third plate mount 14 disposed on the base seat 10, a plurality of positioning plates 40 disposed on the base seat 10, a boot casing 20, four connecting plates 50, and a positioning block 56. The boot casing 20 has four boot plates 21. The first plate mount 12 has a first rail 121, a plurality of first grooves 1211 and a plurality of round holes 122. The second plate mount 13 has two second rails 121, a plurality of second grooves 1311, a center hole 1321 and a spacing 132. The third plate mount 14 has a third rail 141, a plurality of third grooves 1411 and a plurality of circular holes 142. Each of the positioning plates 40 has a rectangular hole 43, a recess 41 and two C-shaped notches 42. Each of the boot plates 21 has a boot wall 212, a round flange 215, a plurality of through holes 211 and a plurality of slots 213 formed on the boot wall 212. Each of the connecting plates 50 has a retaining ring 52, an inserted hole 54 and two C-shaped grooves 51. The positioning block 56 has four protruded flanges 561.

Each of the positioning plates 40 engages with each of the corresponding rails 121, 131 or 141 via each of the corresponding recesses 41. Each of the inserted holes 50 receives each of the corresponding rails 121, 131 or 141. A bolt 55 fastens the connecting plate 50 on the corresponding rail 121, 131 or 141. Each of the round flanges 215 is inserted in the corresponding C-shaped notches 42. Each of the protruded flanges 561 is inserted in each of the corresponding rectangular holes 43. Each of the connecting plates 50 are disposed between two corresponding boot plates 21. A screw 562 fastens the positioning block 56 on the second rail 131. A screw 214 fastens the boot plate 21 on the corresponding plate mount 12, 13 or 14.

A shoe 20 is disposed in the roller skate boot device. The shoe 20 has a vamp 31, a rim 32 and a plurality of threaded holes 321 formed on the rim 32. A screw 216 fastens the boot casing 20 and the shoe 30 via the slot 213 and the threaded hole 321.

Figure 6:
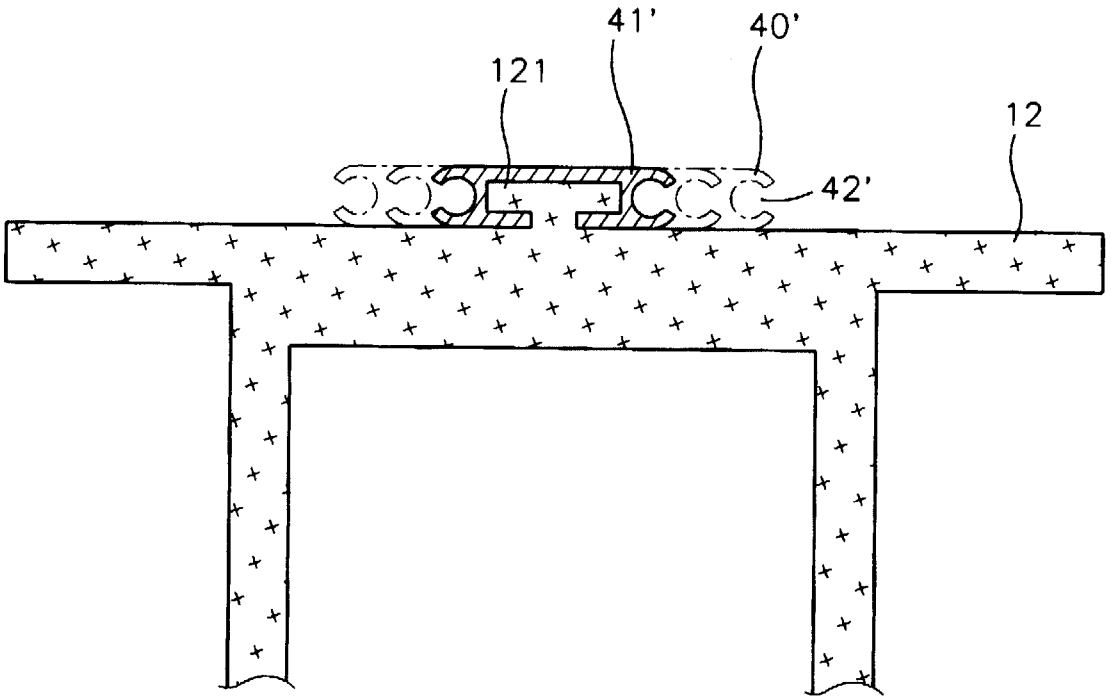
FIG. 6 is a schematic view illustrating an operation of another positioning plate.

Referring to FIG. 6, a plurality of small positioning plates 40' can replace the original positioning plates 40. Each of the small positioning plates 40' has a recess 41' to receive the corresponding rail 121, 131 or 141.

I claim:

1. A roller skate boot device comprises:

a base seat, a first plate mount disposed on the base seat, a second plate mount disposed on the base seat, a third plate mount disposed on the base seat, a plurality of positioning plates disposed on the base seat, four connecting plates, a positioning block, a boot casing having four boot plates, the first plate mount having a first rail, a plurality of first grooves and a plurality of round holes, the second plate mount having two second rails, a plurality of second grooves, a center hole and a spacing, the third plate mount having a third rail, a plurality of third grooves and a plurality of circular holes, each of the positioning plates having a rectangular hole, a recess and two C-shaped notches, each of the boot plates having a boot wall, a round flange, a plurality of through holes and a plurality of slots formed on the boot wall, each of the connecting plates having a retaining ring, an inserted hole and two C-shaped grooves, the positioning block having four protruded flanges, each of the positioning plates engaging with each of the corresponding rails via each of the corresponding recesses, each of the inserted holes receiving each of the corresponding rails, each of the connecting plate fastened on each of the corresponding rails, each of the round flanges inserted in the corresponding C-shaped notches, each of the protruded flanges inserted in each of the corresponding rectangular holes, each of the connecting plates disposed between two corresponding boot plates, the positioning block fastened on the second rail, the boot plate fastened on the corresponding plate mount.

2. A roller skate boot device as claimed in claim 1, wherein a shoe is disposed in the roller skate boot device, and the shoe has a rim and a plurality of threaded holes formed on the rim.

* * * * *